United States Patent [19]

Borland

[11] Patent Number: 4,556,221

[45] Date of Patent: Dec. 3, 1985

[54] BACKGAMMON BOARD GAME FOR THREE PLAYERS

[76] Inventor: Wayne R. Borland, 7 Crescent Pl., Apt. #2308, Toronto, Ontario, Canada, M4C 5L7

[21] Appl. No.: 502,307

[22] Filed: Jun. 8, 1983

[30] Foreign Application Priority Data

Jun. 18, 1982 [CA] Canada ..... 405462

[51] Int. Cl.[4] ..... A63F 3/00

[52] U.S. Cl. ..... 273/248

[58] Field of Search ..... 273/248, 260, 249, 262, 273/261, 255, 243, 246, 250, 251, 252

[56] References Cited

U.S. PATENT DOCUMENTS

| | | | |
|---|---|---|---|
| D. 85,066 | 9/1931 | Sternau | 273/248 X |
| 3,997,165 | 12/1976 | Barsky | 273/260 |
| 4,286,787 | 9/1981 | Barber | 273/248 |
| 4,342,458 | 8/1982 | Lane et al. | 273/248 |

FOREIGN PATENT DOCUMENTS

| | | | |
|---|---|---|---|
| 18222 | 10/1980 | European Pat. Off. | 273/255 |
| 2028668 | 3/1980 | United Kingdom | 273/261 |
| 1586176 | 3/1981 | United Kingdom | 273/248 |
| 2116051 | 9/1983 | United Kingdom | 273/248 |

OTHER PUBLICATIONS

"Race Games"; A History of Board Games by H. J. R. Murray; 12-1972.

*Primary Examiner*—Richard C. Pinkham
*Assistant Examiner*—Matthew L. Schneider

[57] ABSTRACT

A backgammon-type board game including a game board defining a playing surface having lines of demarcation forming three groups of twelve isosceles triangles. Each group is located in a respective rectangular area with one long side of each rectangular area defining one side of a central, equilateral triangle. Three sets of twenty playing pieces each are provided to enable three players to play. Each of these sets comprises two differently marked groups each of which has ten pieces. Three standard dice are used to determine the distance that each player may move when it is his turn.

16 Claims, 6 Drawing Figures

BACKGAMMON BOARD GAME FOR THREE PLAYERS

BACKGROUND OF THE INVENTION

This invention relates to board games and in particular to a board game that can be played by three players and that is similar in some respects to the well known game "Backgammon".

The well known game of Backgammon is played on a board or cloth displaying twenty-four long, triangular spaces known as points, which spaces are generally coloured alternately in two contrasting colours on a background of a third colour. The game is played with playing pieces or men of two different colours, often white and black. There are fifteen pieces for one player and fifteen for his opponent. The game is played with a minimum of two dice and often dice boxes are employed.

In Backgammon the twenty-four points are arranged in two parallel rows with twelve points in each row. A partition or division line divides each row into two sections, generally called "tables", containing six points each. The players take turns in throwing the dice and moving their men or pieces as indicated by the throw of the dice. The game is won by the player who is able to remove all of his men from the board in accordance with the rules of the game.

One difficulty of the known Backgammon game is that it is generally only played by two players. If more than two players wish to play, all the additional players generally play against the player who makes the highest single die throw at the start of the game. The players that are playing in partnership against the single opponent thus have a fewer number of turns than would the players in an ordinary two man game.

It is an object of the present invention to provide a very interesting and entertaining board game that can be played by three players and that has rules similar to the game of Backgammon.

It is a further object of the present invention to provide a game that is more challenging than Backgammon because the pieces or men of each player move in two different directions.

In the game described herein, a player will encounter two "waves" of attack from the front as he moves his men around the board. He may also encounter an attack from the rear if he is too slow to move some of his men. Unlike the usual two man Backgammon game, two opponents in the game described herein can team together to slow a player down or block him.

SUMMARY OF THE INVENTION

According to the invention, a board game comprises a playing surface having lines of demarcation forming three groups of twelve playing positions, each playing position being large enough to accommodate a number of playing pieces and the playing positions of each group being arranged side-by-side in a row, each group of playing positions being positioned along a respective side of a central triangle, three sets of playing pieces with each set having twenty pieces, each set of playing pieces having two differently marked groups of ten pieces each, and three random number selection means each adapted for the random selection of a number from 1 to 6.

Preferably the random selection means consist of three standard dice. If desired, three dice can be provided for each of the three players. In the preferred embodiment the playing pieces are disc shaped and the pieces of each set are coloured differently from the pieces of the other two sets.

A preferred embodiment of the board game will now be described with reference to the accompanying drawings.

DETAILED DESCRIPTION OF PREFERRED EMBODIMENT

Figure 1:
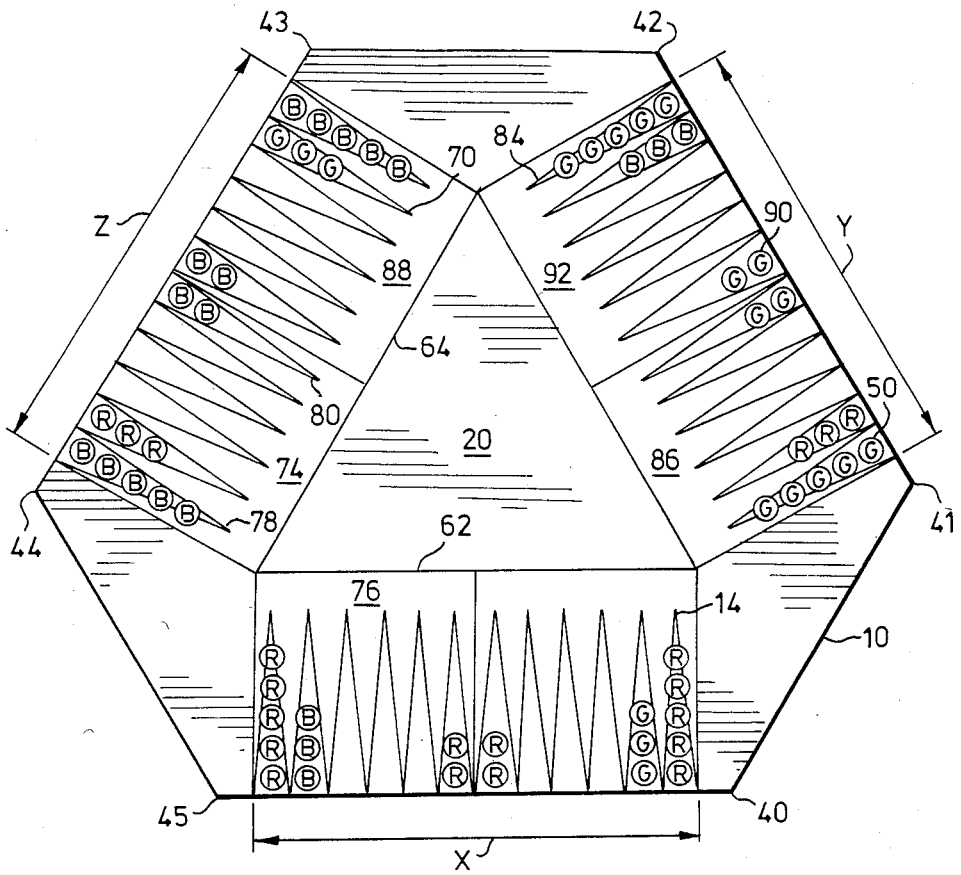
FIG. 1 is a top view of the playing surface with the pieces or men arranged thereon for the start of the game.
Figure 3:
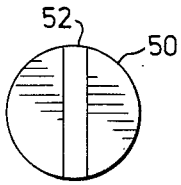
FIG. 3, which appears on the same sheet as FIG. 1, is a top view of a playing piece.
Figure 5:
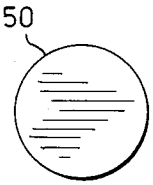
FIG. 5 is a top view of another playing piece.
Figure 4:
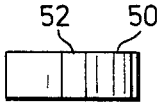
FIG. 4 is a side view of the playing piece of FIG. 3.
Figure 6:
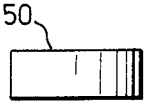
FIG. 6 is a side view of the playing piece of FIG. 5.

The playing surface 10 of the board game of this invention is illustrated in FIG. 1. The applicant calls this board game "Trigammon" and, for purposes of the present application, this name shall be used to refer to the game. The playing surface can be laid out on a board, cardboard, or on cloth. The surface is divided up with lines of demarcation to form three groups labelled X, Y and Z of twelve isosceles triangles 14. Each of these groups is located in a respective rectangular area whose length is twice its width. In one preferred embodiment of the playing surface the length of each rectangle is 30.5 cms or 12 inches and the width is 15.3 cms or 6 inches. The rectangle 16 containing the group Y is shown on a larger scale in FIG. 2. As each of these rectangles is laid out in the same manner, only rectangle 16 will be described in detail. The long side 18 of the rectangle 16 forms one side of a central, equilateral triangle 20. The other long side 20 forms one edge of the playing surface. The shorter sides of the rectangle are located at 22 and 24. The rectangular area 16 is divided in half by a line of demarcation or by an actual physical partition 26 extending transversely across the center of the rectangle. The line 26 thus divides the rectangle into two sections 28 and 30. In the game of Trigammon, these two sections can be called tables. Each section or table contains six of the isosceles triangles 14. These triangles are known as points and they have a height about five times their base 32. In the preferred embodiment of the board game, the height of each point is 12.7 cms or 5 inches and the base is 2.5 cms or 1 inch. There is gap indicated at 34 between the sharp point of each triangle 14 and the long side 18. The edge of the playing surface defined by the long side 20 extends beyond the rectangle 16 a short distance at 36 and 38 to a corner of the playing surface. The surface has a total of six corners 40 to 45 as shown in FIG. 1. Between each pair of corners 40, 41 and 42, 43, and 44, 45 is an end region 46.

If the playing surface is laid out on a board or piece of cardboard, it can be constructed with a fold line at 48 so that the board can be folded upon itself for transport or storage. This is a common feature of many board games. When folded, the board will only take up the area shown in FIG. 2. It will be noted that the fold line 48 is arranged so as to split the center triangle 20 in half.

The preferred playing surface is laid out so that the points or triangles 14 are coloured sequentially in three different colours on a field of a fourth colour. This permits the playing pieces to be moved quickly and accurately by the players and also makes a more attractive surface to play on.

In order to play the board game called Trigammon, each of the three players uses twenty playing pieces or men 50. All twenty men for a single player have the same colour so that a player can easily distinguish his men from the men of the other two players. For purposes of the present description, the three colours that will be used are green, indicated by the letter G in FIG. 1, red, indicated by the letter R, and blue, indicated by the letter B. In addition each set of twenty playing pieces comprises two groups each of which has ten pieces and which are differently marked than the pieces of the other group in the set. FIGS. 3 to 6, which shows two playing pieces from two different views, illustrates one manner of distinguishing one group of playing pieces from the other group. One group, which can be called the right side group can be marked with a straight black line 52 extending diametrically across and around the round playing piece. The other group, which will be called the left side group, has no black line around its edge. It will be clearly understood that the two playing pieces shown in FIGS. 3 to 6, because they belong to the same set used by one player, have the same basic colour. The preferred playing pieces have a diameter of 2.2 cms ($\frac{7}{8}$ inch) and a thickness of 0.9 cm ($\frac{3}{8}$ inch).

At the beginning of the game Trigammon, the playing pieces are arranged in the manner shown in FIG. 1. Briefly the initial layout for the green men will be described and it will be understood that the layout for the other two colours is similar. Five green pieces are located along the uppermost point 54 located in the section 28. Two further green pieces or men are located in the lowermost point 56 located in the same section 28. In addition there are another two green pieces or men located in the uppermost point 58 of the section 30. There are five additional green men located along the lowermost point 60 in the section 30. There are also green men located in the other two rectangles 62 and 64 containing groups X and Z. The right table in rectangle 62 is indicated by 66 in FIG. 2. Three green men are placed on the point 68 located second from the right on the table 66. The final three green men are located in the left table of rectangle 64 on the point indicated at 70 in FIG. 1.

The board game Trigammon is played with at least three random selection means each adapted for the random selection of a number from 1 to 6. Preferably the random selection means consist of standard dice but conceivably other selection means such as a spinning pointer or cards might be used. In order for the game to proceed quickly, each player should be provided with his own set of three dice. It will be appreciated however that a single set of three dice could be shared amongst the players if necessary. Also it is common to use dice-boxes to shake the dice before they are rolled. Preferably one dice box is provided for each player.

There are a number of terms used in the well known game Backgammon that may also be used to describe and explain the new game Trigammon. Some terms used in Trigammon are the following:

RIGHT INNER TABLE—The table or section of the board into which all of the right side men of a player have to be moved before they can be removed entirely or "borne" off.

LEFT INNER TABLE—The table or section of the board into which all of the left side men of a player have to be moved before they can be removed entirely or "borne" off.

Figure 2:
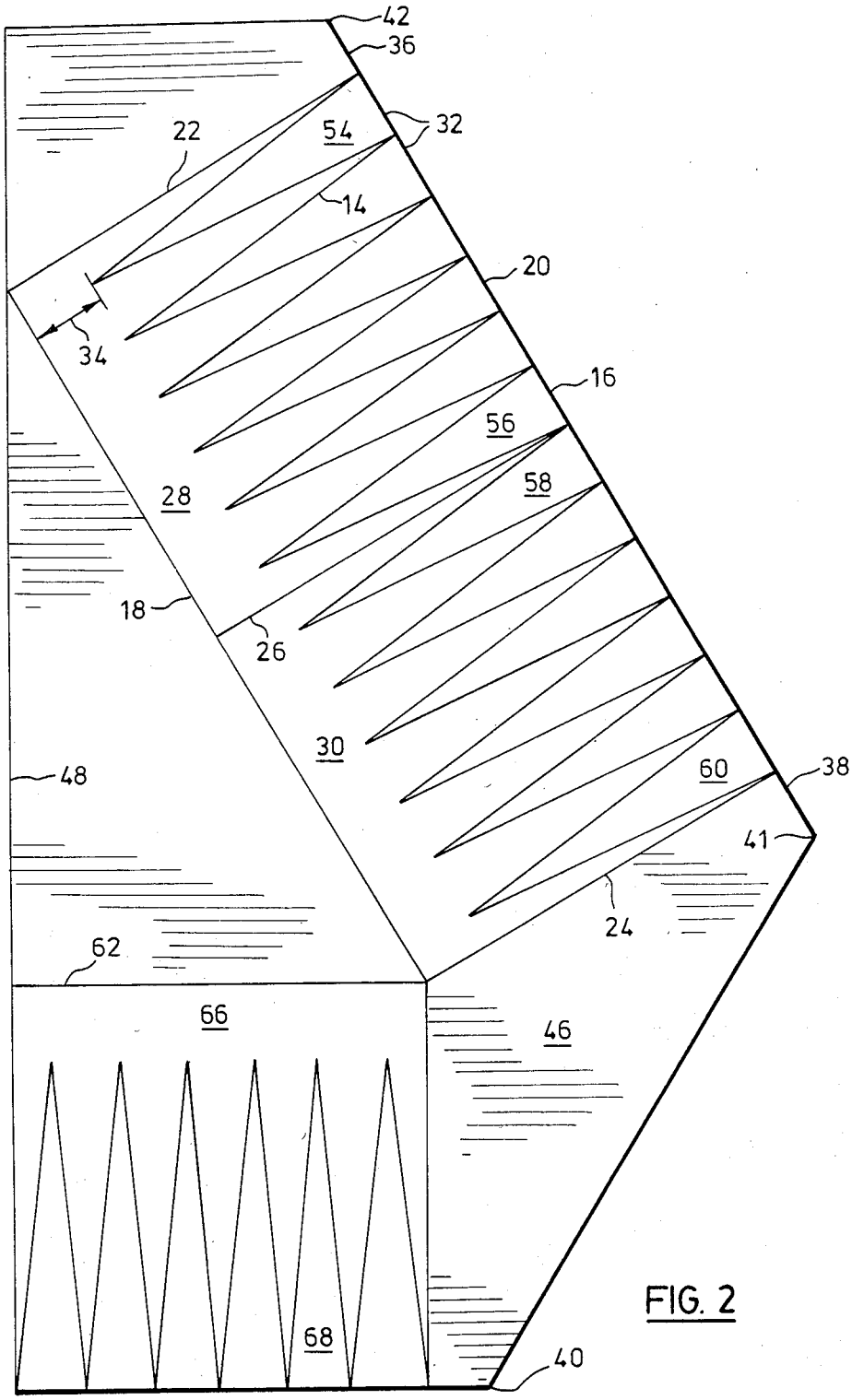
FIG. 2 is a top view of the right hand side of the playing surface on a larger scale.

BAR—The partition or division line that divides each rectangle in half (for example the line 26 in FIG. 2).

BLOT—A lone man or piece on a point (such a piece may be "hit" by an opponent's move and, if this occurs, the piece is removed to the "bar" to start again).

A HIT—The movement of a playing piece to a point on which there is a single piece belonging to an opponent.

RE-ENTER—This occurs when a player starts a playing piece that has been hit by an opponent. The man is moved from the bar to a point indicated by the dice thrown. No other man on the same side can be moved until a hit man has been re-entered.

A BLOCK—This is created by positioning two or more men on a point. The playing pieces of each opponent cannot land on such a point but they may pass over it. If there are two or more men on a point, these men cannot be hit by an opponent.

THE RULES FOR PLAYING TRIGAMMON

Except as explained herein, the rules for Trigammon are the same as those in Backgammon or are analogous thereto. The game of Trigammon is won by being the first player to bear all of your playing pieces off the board. In order to do this the ten right side pieces must be moved to the player's right inner table and the left side playing pieces must be moved to the left inner table. However it is not necessary to have both the right and left side playing pieces all moved to their respective inner tables before any pieces can be borne off. In other words a player may start bearing off left side playing pieces even though some of his right side playing pieces have not yet reached the right inner table.

To illustrate with a specific example, with reference to FIG. 1, the right side green pieces must all be moved to green's inner table located at 74. Once the ten right side green pieces are all on some or all of the six points located in table 74, the green player may begin to bear these men off whether or not his left side pieces have reached the left inner table located at 76.

The three players take turns at throwing three dice in a clockwise direction around the table. A single roll of three dice can be used entirely on the right side pieces or the left side pieces or can be split so as to move one or two pieces on the right side and one or two on the left side. As in Backgammon, the total of the three dice may be used to move a single man if desired. Thus if a player throws 4, 2, 1, he may move one of his pieces a distance of 7 points.

If a set of doubles is thrown by a player, that player then plays double what he has thrown. Accordingly if a player obtains a doublet of 4 as well as some other number, he plays four 4's instead of a mere two 4's. In addition he plays the other number that has been thrown with the third die.

Because three dice are thrown each time, it is also possible to throw a triplet, for example three 6's. Like a doublet, a triplet may be used anywhere on the board and it gives the player a total of six moves. Thus if a player throws a triplet of 6, he may move six pieces a distance of 6 points each or three pieces a distance of 12 points each or he may use any other combination of six 6's.

A player may not move to any point on which two or more pieces of an opponent are positioned. In addition if a player desires to move a piece with a count of two dice, he cannot do so if the count of a single die would land him on a point that has been blocked by an opponent. This rule applies to doublets and triplets as well. If a number thrown cannot be played, then that part of the turn is lost. Also a player must always move his men if at all possible.

If a piece or man is hit and removed to the bar of the hit player, no other pieces of that player on that side may be moved until the hit piece has been re-entered. When the player who has been hit has his normal turn, he must try to throw an exact roll for an unguarded point on the side of the piece that has been hit. No other pieces can be moved on the side that has been hit until the hit piece is re-entered. If the piece that has been hit was a right side piece, the left side pieces may still be moved even though the player has been unsuccessful in his attempt to re-enter the right side piece. It is possible of course that a player's pieces on both the right and left side could be hit or bumped off. If this occurs that player cannot move pieces on either side until at least all men on one of the two sides that have been hit have been re-entered into the game.

As indicated once a player has moved all of his right side men into his right inner table, he may then take his men or pieces off the board, called bearing the men. This procedure will now be described with reference to the green player of FIG. 1. The points on the green player's inner table 74 are numbered 1 to 6 with point 1 being located at 78 and point 6 located at 80. Thus if the green player has pieces on points 1, 3 and 5 and he throws a 1, 3 and a 5, he may bear all these men off. On the other hand, if he also has men on the 2, the 4, and the 6 point, he may decide to move the piece on the 2 point to the 1 point, the piece on the 4 point to the 1 point and the piece on the 6 point to the 1 point. If he cannot move any men on the inner table except by bearing men off then he must bear men off. As in Backgammon, if he throws a number which is higher than any of the points on which he has men, the player must remove the man that occupies the highest point.

There are several interesting aspects to the game of Trigammon that are not encountered in the known Backgammon game. In Trigammon each player will encounter two waves of attack coming from the front on each side. This can be appreciated by considering the movement of the green pieces located at 84 in FIG. 1. As indicated, these five right side pieces must be moved to the inner table located at 74. While this is occurring the blue player's left side pieces must be moved past them to blue's left inner table at 86. Thus blue's left side pieces will provide the first wave of attack against green's right side pieces. Also, at the same time the red player's left side pieces must be moved to reds left inner table at 88. Thus the red left side pieces must also be moved past the green right side pieces and they will provide a second wave of attack. Because one player may be attacked by both of his opponents, it is possible for his opponents to team together to slow that player down or block him.

Another interesting feature is that a player may encounter an attack from the rear if he is too slow to move some of his men. For example, consider the situation of the two green right side pieces located at 90. These pieces are moving to the right towards greens inner table at 74. Red's right side pieces will be moving into red's right inner table at 92. Accordingly there is a possibility that if a green piece is left for too long in red's inner table 92, it may be attacked from the rear by red's right side pieces.

A useful feature of the present board game is that it can be used to play ordinary Backgammon if desired or if there are only two persons who wish to play. In this case only two of the groups of points X, Y and Z are used and of course only two playing piece colours are used. If blue and green are the colours to be used, five blue men and five green men are set aside so as to leave only fifteen men for each player. Also only two dice are thrown on each turn.

What I claim as my invention is:

1. A board game comprising a unitary playing surface having lines of demarcation forming three groups of twelve isosceles triangles with each group located in a respective rectangular area, three sets of playing pieces with each set having twenty pieces, the playing pieces in each set being distinguishable in appearance from any playing piece in any other set, each set of playing pieces comprising two groups each of which has ten pieces and which are differently marked from the pieces of the other group in the set, and three random selection means each adapted for the random selection of a number from 1 to 6.

2. A board game according to claim 1 wherein said random selection means consist of three standard dice.

3. A board game according to claim 2 wherein each of the three rectangular areas are divided in half by a line of demarcation extending transversely across the center of said rectangle so that each section formed by said line contains six isosceles triangles.

4. A board game according to claim 2 wherein the isosceles triangles in each group are arranged side-by-side and are coloured alternately in two contrasting colours.

5. A board game according to claim 1 wherein the playing pieces are disc shaped and the pieces of each set are coloured different from the pieces of the other two sets.

6. A board game according to claim 1 wherein each rectangular area measures about 30.5 cms long by 15.3 cms wide and said isosceles triangles each measure about 12.7 cms in height and 2.5 cms along the base.

7. A board game comprising a playing surface having lines of demarcation forming three groups of twelve playing positions, each playing position being large enough to accommodate a number of playing pieces and the playing positions of each group being arranged side-by-side in a row, said three groups of positions outlining a central triangle, each group being positioned along a respective side of said central triangle, three sets of playing pieces with each set having twenty pieces, each set of playing pieces having two differently marked groups of ten pieces each, and three random number selection means each adapted for the random selection of a number from 1 to 6.

8. A board game according to claim 7 wherein said random selection means consist of three standard dice.

9. A board game according to claim 7 wherein the playing pieces are disc shaped and the pieces of each set are coloured differently from the pieces of the other two sets.

10. A board game according to claim 7 wherein said central triangle is equilateral and each group of playing positions is arranged in a rectangular area having one long side defining one side of said central triangle.

11. A board game according to claim 10 wherein each of the three rectangular areas are divided in half by a line of demarcation extending transversely across the center of the rectangle.

12. A board game comprising a playing surface having lines of demarcation forming three groups of twelve isosceles triangles with each group located in a respective rectangular area, the three rectangular areas being located so that they define between themselves a central, equilateral triangle, one long side of each of said rectangular areas defining a side of said central triangle, three sets of playing pieces with each set having twenty pieces, each set of playing pieces comprising two groups each of which has ten pieces and which are differently marked than the pieces of the other group in the set, and three random selection means each adapted for the random selection of a number from 1 to 6.

13. A board game according to claim 12 wherein the playing pieces are disc shaped and the pieces of each set are coloured different from the pieces of the other two sets.

14. A board game according to claim 12 wherein said random selection means consist of three standard dice.

15. A board game according to claim 14 wherein each of the three rectangular areas are divided in half by a line of demarcation extending transversely across the centre of said rectangle so that each section formed by said line contains six isosceles triangles.

16. A board game according to claim 15 wherein the isosceles triangles in each group are arranged side-by-side and are coloured alternately in two contrasting colours.

* * * * *